US006659026B1

(12) United States Patent
Hendricks et al.

(10) Patent No.: US 6,659,026 B1
(45) Date of Patent: Dec. 9, 2003

(54) CONTROL SYSTEM FOR REDUCING $NO_X$ EMISSIONS FROM A MULTIPLE-INTERTUBE PULVERIZED-COAL BURNER USING TRUE DELIVERY PIPE FUEL FLOW MEASUREMENT

(75) Inventors: Willis M. Hendricks, Gahanna, OH (US); John J. Letcavits, Hilliard, OH (US)

(73) Assignee: AEP EmTech LLC, Columbus, OH (US)

( * ) Notice: Subject to any disclaimer, the term of this patent is extended or adjusted under 35 U.S.C. 154(b) by 0 days.

(21) Appl. No.: 10/060,587

(22) Filed: Jan. 30, 2002

(51) Int. Cl.[7] ..... F23D 1/00; F23C 1/10; F23C 1/12; F23N 5/18

(52) U.S. Cl. ..... 110/347; 110/186; 110/261; 431/12

(58) Field of Search ..... 110/345, 347, 110/261, 262, 263, 264, 186, 185; 431/12, 76, 89, 90, 10, 188, 187

(56) References Cited

U.S. PATENT DOCUMENTS 4,373,451 A * 2/1983 Gardner et al. ..... 110/101 CC
4,408,569 A * 10/1983 Novak
4,540,129 A * 9/1985 Zadiraka ..... 241/34
4,807,541 A * 2/1989 Massai et al. ..... 110/262
4,882,934 A * 11/1989 Leffert et al. ..... 73/861.04
4,903,901 A * 2/1990 Kim et al. ..... 241/33
5,429,060 A * 7/1995 Tokuda et al. ..... 110/263
5,694,869 A * 12/1997 Breen et al. ..... 10/345

OTHER PUBLICATIONS

*Online coal flow measurement –new technology for the Optimisation of the combustion at PS Wilhelmshaven*, Marco Tappen, presented at VGB Conference Feuerungen, Kassel, Germany, Nov. 7–8, 2001, and at PowerGen Europe Conference, May 29–31, 2001.

*Measuring the coal dust volume in burner pipes –a new type of measurements to improve firing*, Marco Tappen, VGB PowerTech, v 80, n 11, pp. 30–34, Nov., 2000.

*Coal dust volume metering for optimisation*, Marco Tappen and H.J. Urselmann, presented at VGB conference on Steam Generator Systems, Leipzig, Germany, Nov. 24–26, 1998; published in VGB Kraftwerkstechnik Verl., p. 10, 1999.

* cited by examiner

*Primary Examiner*—Ira S. Lazarus
*Assistant Examiner*—K. B. Rinehart
(74) *Attorney, Agent, or Firm*—Standley & Gilcrest

(57) ABSTRACT

A control system for providing improved control over the combustion process of a multiple-intertube pulverized-coal burner that commonly forms a portion of a roof-fired boiler. The system utilizes actual mass fuel flow measurements to calculate corrected, optimal secondary and interjectory air demands. The corrected secondary and interjectory air demands are used by a proportional and integral control loop to regulate the respective supply of secondary and interjectory air to the combustion process of each in-service burner. The control system allows for optimal combustion of the fuel and a reduction in $NO_x$ emmissions.

13 Claims, 2 Drawing Sheets

CONTROL SYSTEM FOR REDUCING $NO_X$ EMISSIONS FROM A MULTIPLE-INTERTUBE PULVERIZED-COAL BURNER USING TRUE DELIVERY PIPE FUEL FLOW MEASUREMENT

BACKGROUND AND SUMMARY OF THE INVENTION

The present invention relates to a control system and method for reducing the $NO_x$ emissions from a multiple-intertube pulverized-coal burner. More specifically, the present invention relates to a control system and method for use with the combination of a known $NO_x$ emission reduction system and an improved means of detecting and monitoring the true mass flow of pulverized coal through each burner delivery pipe. The control system and method allows for better control of the burner stoichiometry and, therefore, a further reduction of $NO_x$ emissions from such a burner.

$NO_x$ refers to the combination of nitric oxide (NO) and nitrogen dioxide ($NO_2$) gases, which may be produced during the burning of coal when nitrogen is released from coal particles in the presence of excess oxygen. Both NO and $NO_2$ are classified as pollutants under the Clean Air Act and, therefore, a reduction in the emission thereof is highly desirable.

In an electric power plant, multiple-intertube pulverized-coal burners commonly form part of a roof-fired boiler that is used to generate steam for driving electrical energy-producing generators. Such a roof-fired boiler will typically have more than one multiple-intertube pulverized-coal burner. The multiple-intertube pulverized-coal burners typically utilize a series of coal pulverizing mills that pulverize larger pieces of coal into much smaller particles. These coal particles are then carried by a primary air supply through a plurality of coal supply pipes to the multiple-intertube pulverized-coal burners for subsequent combustion within a combustion chamber. As mentioned previously, during the combustion process NO and $NO_2$, as well as other undesirable gases, may be produced. However, it has been found that the amount of these gases produced can be reduced by better controlling the stoichiometry of the combustion process.

A method and apparatus that may be retrofitted to existing multiple-intertube pulverized-coal burners to provide such a reduction through improved stoichiometry has been previously disclosed in U.S. Pat. Nos. 5,771,823, 5,960,723, and 6,155,183, all of which are incorporated by reference herein. In U.S. Pat. Nos. 5,771,823, 5,960,723, and 6,155,183, the method and apparatus controls the amount of both secondary and interjectory air to better regulate the combustion process.

The method and apparatus disclosed in U.S. Pat. Nos. 5,771,823, 5,960,723, and 6,155,183 controls the amount of secondary air and supplies the secondary air to the burners in an internal two-stage process. The first stage includes secondary air dampers and air flow stations that regulate the amount of secondary air to the burners. A portion or balance of the required secondary air is directed through hot air ducts to interjectory air plenums located along the furnace front wall. The secondary air flowing directly to the burners is baffled to provide a low velocity, fuel-rich central core for combustion of the fuel's volatile component in a reducing environment. The periphery of the burner maintains an oxygen-rich boundary layer that protects against reducing environments along waterfalls and corrosion potentials, and provides sustained combustion of the fixed carbon. The second stage of the process then uses one modulating interjectory air port per burner to provide the balance of the required total combustion air and sufficient turbulence to complete the combustion process. This two-stage process provides for a precise measurement of both secondary and interjectory air to the burners at all times, allowing enough combustion air to support both the burning of the fuel's volatile component and the fixed carbon, while limiting the supply of excess oxygen to reduce the potential of the fuel-bound nitrogen released with the burning of the volatile component and atmospheric nitrogen from being converted to $NO_x$.

In order to attain the most ideal possible burner stoichiometry by the above apparatus and method, it is necessary to accurately control the air/fuel ratio in each individual burner. Unfortunately, because a single coal pulverizing mill may serve multiple burners through multiple supply pipes, it has been difficult in the past to obtain the true mass flow of coal to a given burner and, thus, an accurate air/fuel ratio. One method of determining the mass flow of coal has been to measure the amount of bulk coal entering each pulverizer and to divide that amount by the number of delivery pipes connected thereto. Alternatively, a flow sensor may be employed to measure the mass flow leaving the pulverizer and the measurement thus obtained may be divided by the number of delivery pipes to calculate a theoretical mass flow through each pipe. However, due to dimensional differences from pipe-to-pipe, clogging or build-up in certain pipes but not others, and because of numerous other variants that can cause the flow of coal through one supply pipe to differ from that of the next, the assumption of equivalent mass flow of coal to each burner is erroneous and has often led to a less than optimum air/fuel ratio within a given burner.

The proper combustion process for coal requires approximately 7.5 pounds of air for every 10,000 BTU of coal. Although the BTU rating for coal used in a typical multiple-intertube pulverized-coal burner may vary from approximately 9,500 BTU/pound to approximately 12,500 BTU/pound, the actual BTU rating of the coal used at any particular location, at any given time, is generally known from testing. Thus, by accurately determining the mass flow rate of pulverized coal through a particular supply pipe, a proper amount of combustion air can be supplied to the burner to which the supply pipe is connected, and the burning of the coal can be optimized.

Sensors have been developed that may be used to accurately determine the mass flow rate of a substance, such as coal, through a conduit. Certain of these sensors use electrodes to measure the electrostatic charge of the particles traveling through the conduit; others monitor microwave absorption, attempt to directly measure air flow with and without particles entrained therein, measure the impact of particles, or measure the travel time of ultrasonic signals. Another type of sensor can measure the mass flow of coal particles by generating an alternating electric field within a feed pipe, measuring the attenuation of the electric field, and employing a derivation process to determine the quantity of solids in the flow. This type of sensor has proven particularly amenable to use with the present invention, and an exemplary device is disclosed in U.S. Pat. No. 6,109,097.

What is needed and has been heretofore unavailable, however, is a system employing a combination of the emission reduction method and apparatus disclosed in U.S. Pat. Nos. 5,771,823, 5,960,723 and 6,155,183 with an accurate means of determining the mass flow rate of pulverized coal through each burner supply pipe, such as the sensor disclosed in U.S. Pat. No. 6,109,097. In this manner, an optimum reduction in $NO_x$ emissions from a multiple-intertube pulverized-coal burner may be realized. The present invention contemplates such a system, and more specifically a control system and method for allowing the successful operation of such a system.

To improve the performance of a $NO_x$ emission reducing roof-fired boiler, the control system and method of the present invention is able to control the technology disclosed by U.S. Pat. Nos. 5,771,823, 5,960,723 and 6,155,183, while also incorporating input data from a mass flow sensor located in each coal supply pipe, preferably a sensor such as that disclosed in U.S. Pat. No. 6,109,097. The mass flow of coal through each burner supply pipe is measured and summed to determine the total mass flow of coal to the furnace. The ratio of coal flow through a given burner pipe to that of the average for all burner pipes on in service burners is also determined. The steam flow for the boiler is also known, and is used to determine the total theoretical combustion air required at each burner, including primary, secondary, and interjectory air. This combustion air demand may then be corrected based on the actual coal flow to each burner so that the stoichiometric ratio of the combustion air and fuel (coal) is properly maintained, thereby producing less pollutants.

BRIEF DESCRIPTION OF THE DRAWINGS

In addition to the novel features and advantages mentioned above, other objects and advantages of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
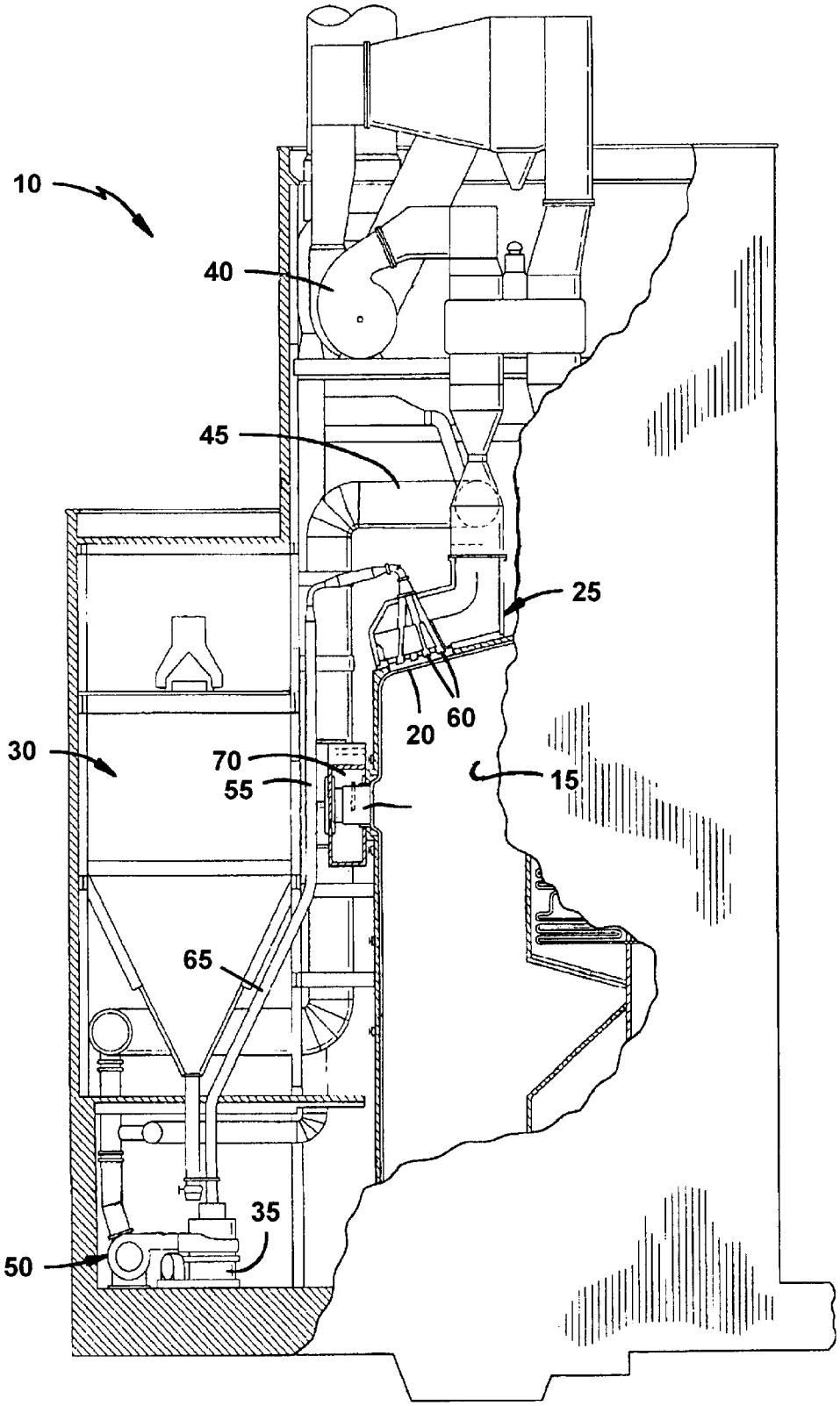
FIG. 1 is a cutaway view of a typical pulverized-coal burning multiple-intertube roof-fired boiler of the present invention.

An overview of an embodiment of a pulverized-coal burning multiple-intertube roof-fired boiler 10 according to the present invention is illustrated in FIG. 1. Such a boiler 10, burns fuel, in this case coal, in order to produce steam to run electricity-producing generators. To produce steam, the coal is burned in a combustion chamber 15 containing a plurality of water-carrying pipes 20, whereby the heat of combustion converts the water therein into steam. The combustion chamber 15 may communicate with a number of burners 25 at which the actual combustion occurs.

A supply of coal is typically maintained in one or more bins 30 that are connected to one or more coal pulverizing mills 35. The coal pulverizing mills 35 convert the coal from larger chunks into finer particles that may be more easily entrained via an air stream for transport to the burners. A forced draft fan 40 is typically located near the top of the boiler 10 in order to supply a primary air stream for carrying the coal particles. The primary air is supplied to the pulverizing mills 35 via primary air ducts 45 connected thereto. A booster fan 50 may also be provided to increase the flow rate of the pulverized coal and primary air leaving the pulverizing mills 35 and entering the coal supply pipes 55 leading to the burners 25. Typically there is a single coal supply pipe for each burner, but one pulverizing mill may supply more than one burner. The primary air and entrained coal particles travel through the coal supply pipes 55 and are eventually distributed through multiple burner tips 60 into the combustion chamber 15, where the coal particles are ignited and burned.

The present invention regulates the amount of combustion air supplied to each burner 25 in order to optimize the burner stoichiometry. In contrast to known systems, the system of the present invention determines the amount of combustion air required based on the actual mass flow of coal to each burner 25, thereby enabling a more accurate air/fuel ratio to be maintained. The combustion air is comprised of the primary air supply carrying the pulverized coal particles, as well as a regulated amount of secondary and interjectory air. A mass flow sensor 65 is provided in each coal supply pipe 55 to determine the actual mass flow of coal particles to each burner. It should be understood that a mass flow sensor 65 may be located at any of a variety of points within each coal supply pipe 55. It may also be possible to utilize more than one mass flow sensor 65 within a single coal supply pipe, and to average the readings thereof to determine the mass flow of the coal particles traveling therethrough.

Figure 2:
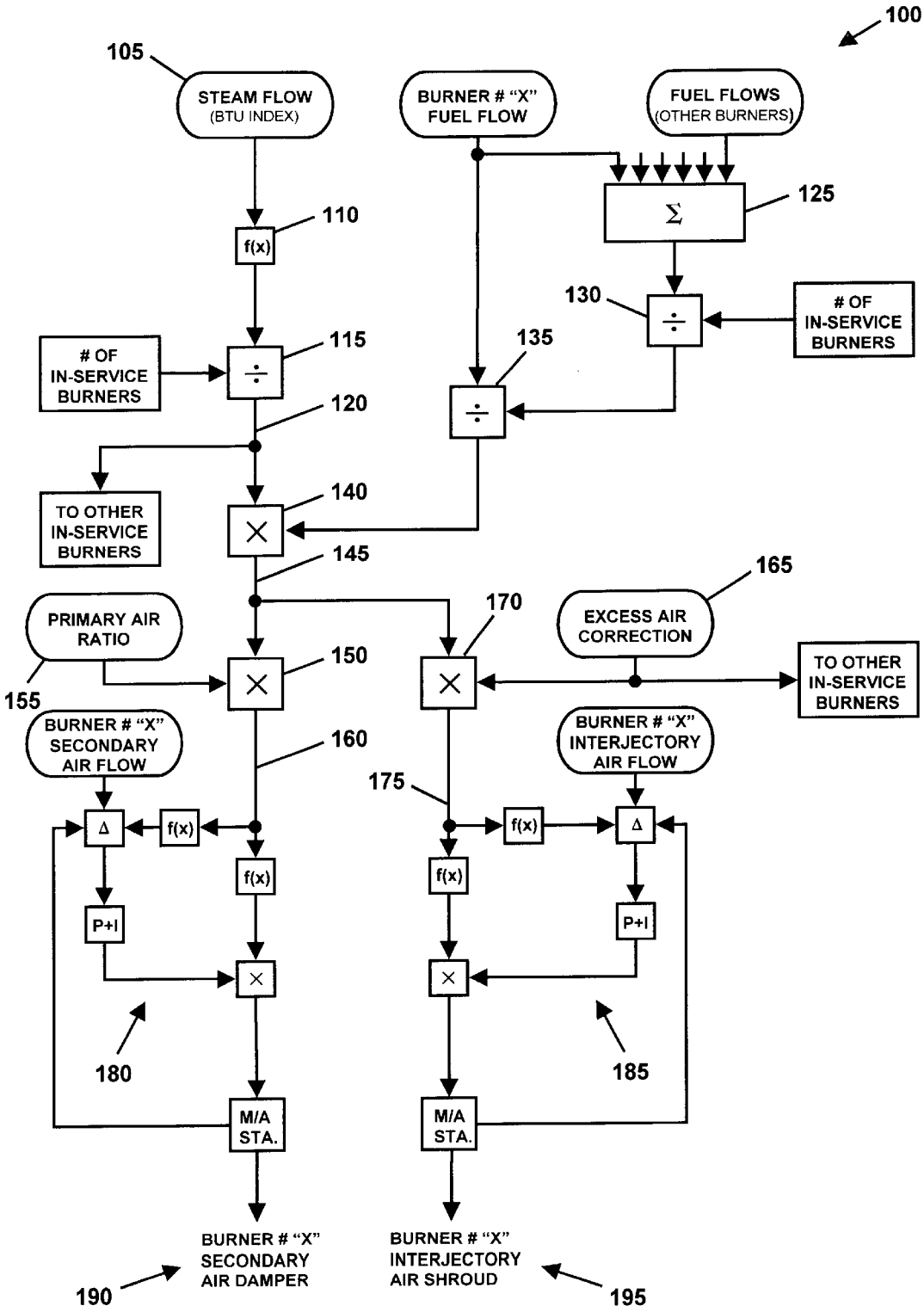
FIG. 2 is a schematic diagram of a control system of the present invention.

The control system 100 of the present invention is illustrated in the schematic diagram of FIG. 2. Since the required boiler output and the boiler efficiency are known, the steam flow output 105 of the boiler 10 is used to determine the amount of coal required to be input to the boiler, and also the amount of combustion air (secondary air) required 110 to support the burning of the coal in the combustion chamber 15. Because a typical boiler of the present invention generally has a number of individual burners 25, it is necessary to determine the amount of combustion air required per burner by dividing 115 the total amount of combustion air required 110 by the number of burners in service. The resulting value represents the per burner average secondary air demand 120 for the system.

In order to accurately control the combustion process, it is also necessary to know the actual fuel (coal) flow to each burner. To this end, the flow of pulverized coal particles through each coal supply pipe 55 is measured using the mass flow sensor 65 located therein. The flow measurement from each coal supply pipe 55 is then summed 125 to obtain the total fuel mass flow to the furnace. The total mass flow of fuel to the furnace is then divided 130 by the total number of burners in service to obtain an average fuel mass flow per burner. However, as discussed above, due to differences in piping size and configuration, as well as build-up and other factors, the fuel mass flow to each burner is typically not equal. Consequently, it is preferable to determine the percentage of fuel mass flow to a given burner relative to the average fuel mass flow for all of the in-service burners. This percentage is derived by dividing the measured value of the fuel mass flow through each burner supply pipe 55 as recorded by each mass flow sensor 65, by the average fuel mass flow per burner 135 obtained above. Thus, a given burner supply pipe 55 may have a fuel mass flow that is, for example, 100%, 90%, or 75% of the average fuel mass flow per burner. This percentage represents the ratio of mass or BTU's of fuel flowing to each burner as compared to the other in-service burners.

The percentage of fuel mass flow to each burner is then multiplied 140 by the per burner average secondary air demand 120 for the system, which was determined previously. This value 145 is then used to adjust the combustion air flow to each burner. Such an adjustment is necessary because secondary air is not the only contributor to the combustion process. As mentioned above, the primary air used to carry the pulverized coal particles to the burners 25 also contributes to the combustion of the coal in the combustion chamber 15. It is, therefore, necessary to correct the calculated combustion air demand to reflect the contribution to combustion of the primary air flow. As the primary air flow rate is known, the ratio of primary air flow to combustion air demand may be determined. The value 145 obtained by multiplying 140 the percentage of fuel mass flow to each burner by the per burner average secondary air demand 120 for the system is then multiplied 150 by the primary air ratio 155 to obtain a corrected secondary air demand 160 that may be sent to a secondary air controller provided for each burner. This corrected secondary air demand 160 reflects not only the true value of secondary air required to support proper combustion, but also the true percentage of fuel mass flow to the particular burner.

As discussed above, combustion air demand also includes interjectory air, which is preferably provided on a per burner basis. Interjectory air is necessary to achieve char burn out and to oxidize carbon monoxide within the combustion chamber. To ensure the proper amount of interjectory air is introduced to the combustion process, the interjectory air demand is corrected 165. This may be accomplished by measuring the amount of excess oxygen present in the furnace exhaust gases. The excess oxygen correction factor 165 is then multiplied 170 by the value 145 obtained by multiplying 140 the percentage of fuel mass flow to each burner by the per burner average secondary air demand 120. In this manner, it is possible to accurately regulate the percentage of oxygen to promote safe combustion and to maintain the atmosphere inside the furnace within a non-reducing range.

Once corrected secondary and interjectory air demands 160, 175 are obtained, the supply of each is controlled using a proportional and integral (PI) control loop 180, 185. The proportional and integral control loops 180, 185 compare the secondary and interjectory air demand to the actual secondary and interjectory air flow, respectively. A proportional and integral controller in communication with each control loop can then make adjustments to a secondary air damper 190 or interjectory air register 195 as necessary to ensure that the calculated amount of secondary air and interjectory air is sent to the burners. The PI control loop continually monitors the corrected air demands and makes adjustments to the air flows accordingly.

As can be understood from the above description, the system of the present invention is able to control the combustion process within a pulverized-coal burning multiple-intertube roof-fired boiler more accurately than has heretofore been possible. The system of the present invention incorporates the actual mass flow of fuel (coal) to each burner into the equations used to regulate the combustion process. This allows a more complete and clean burning of the fuel within the combustion chamber than is possible with known systems, wherein coal flow to each burner is generally assumed to be equivalent and equal to the amount of bulk coal entering each pulverizer divided by the number of delivery pipes connected thereto. Thus, the system of the present invention allows a pulverized-coal burning multiple-intertube roof-fired boiler to operate with a reduced level of $NO_x$ emmissions not previously possible.

While certain embodiments of the present invention are described in detail above, the scope of the invention is not to be considered limited by such disclosure, and modifications are possible without departing from the spirit of the invention as evidenced by the following claims:

What is claimed is:

1. A method of controlling the fuel combustion process of a multiple-intertube roof-fired boiler, said method comprising:

determining the fuel input requirements of said boiler;

measuring the actual mass flow of fuel to each burner of said boiler;

calculating an adjusted combustion air demand for each burner using the average amount of combustion air required per burner and the average percentage fuel mass flow for each burner;

calculating a corrected secondary air demand for each burner that takes into account the contribution of a primary air flow to the combustion process;

calculating a corrected interjectory air demand using said adjusted combustion air demand and a measured amount of oxygen existing in exhaust gases exiting said boiler; and using said corrected secondary and interjectory air demands to adjust a respective flow of secondary and interjectory air to each burner.

2. The method of claim 1, wherein said mass flow of fuel is measured by at least one sensor located in a supply pipe that transports said fuel to said burner.

3. The method of claim 1, wherein said flow of secondary air to each burner is adjusted by a proportional and integral controller.

4. The method of claim 3, wherein said proportional and integral controller communicates with an adjustable air damper to regulate said flow of secondary air.

5. The method of claim 1, wherein said flow of interjectory air to each burner is adjusted by a proportional and integral controller.

6. The method of claim 5, wherein said proportional and integral controller communicates with an adjustable register to regulate said flow of interjectory air.

7. The method of claim 1, wherein said fuel is pulverized coal.

8. The method of claim 7, wherein said pulverized coal is transported to each of said burners by entrainment within an air stream.

9. In a method of controlling the fuel combustion process of a multiple-intertube roof-fired boiler, wherein a flow of both secondary air and interjectory air to each burner of said boiler are regulated to optimize combustion, the improvement comprising:

locating a mass flow sensing device in each fuel supply pipe transporting fuel to each burner of said boiler;

measuring the actual mass flow of fuel to each burner;

calculating a percentage fuel mass flow for each burner using said actual mass flow of fuel to each burner;

determining an adjusted combustion air requirement using the average amount of combustion air required per burner and said percentage fuel mass flow for each burner;

calculating a corrected secondary air demand for each burner using said adjusted combustion air requirement and a primary air ratio;

calculating a corrected interjectory air demand using an interjectory air demand correction factor and said adjusted combustion air requirement; and using said corrected secondary and interjectory air demands that take into account the actual fuel mass flow to each burner to regulate the respective flow of secondary and interjectory air to each burner.

10. A control system for controlling the fuel combustion process of a multiple-intertube roof-fired boiler, said control system comprising:

a device for controlling a secondary air flow to each burner of said boiler;

a device for controlling an interjectory air flow to each burner of said boiler;

a device for measuring the actual mass flow of fuel through each fuel supply pipe connected to each burner of said boiler;

means for calculating a corrected secondary air demand for each burner that accounts for the contribution of a primary air flow to said combustion process, as well as the percentage of fuel mass flow actually being delivered to each of said burners relative to the average fuel mass flow to all in-service burners;

means for calculating a corrected interjectory air demand for each burner;

a proportional and integral control loop associated with said device for controlling said secondary air flow to each burner; and a proportional and integral control loop associated with said device for controlling said interjectory air flow to each burner;

whereby said proportional and integral control loops adjust the air flow to the combustion process according to the corrected secondary and interjectory air demands by communicating with their associated control devices controlling each of said secondary and interjectory air flows, respectively.

11. The control system of claim 10, wherein said device for controlling the secondary air flow to each burner is an adjustable air damper.

12. The control system of claim 10, wherein said device for controlling the interjectory air flow to each burner is an adjustable register.

13. A method of controlling the fuel combustion process of a multiple-intertube roof-fired boiler, said method comprising:

determining the required output of said boiler;

determining the fuel input requirements of said boiler based on said required boiler output, boiler efficiency, and the energy output per unit of said fuel;

calculating the total amount of air required to support combustion of said fuel input to said boiler;

determining the average amount of combustion air required per burner of said boiler by dividing the total amount of combustion air required by the number of burners in service;

measuring the actual mass flow of fuel through each supply pipe connected to each burner of said boiler by means of at least one sensor located in each of said supply pipes;

obtaining a total fuel mass flow to the boiler by summing said fuel mass flow measurements;

calculating an average fuel mass flow per burner by dividing said total fuel mass flow by the number of burners in service;

determining a percentage fuel mass flow for each burner by dividing said average fuel mass flow to the burners by the measured fuel mass flow to each of said burners;

calculating an adjusted combustion air requirement by multiplying said average amount of combustion air required per burner by said percentage fuel mass flow for each burner;

determining the ratio of primary air to the amount of combustion air required;

calculating a corrected secondary air demand for each burner by multiplying said adjusted combustion air requirement by said primary air ratio;

measuring the amount of excess oxygen present in exhaust gases leaving said boiler to obtain an interjectory air demand correction factor;

calculating a corrected interjectory air demand by multiplying said interjectory air demand correction factor by said adjusted combustion air requirement;

adjusting the flow of secondary air to said combustion process of each burner in response to said corrected secondary air demand by using a proportional and integral control loop to actuate an adjustable secondary air damper; and adjusting the flow of interjectory air to said combustion process of each burner in response to said corrected interjectory air demand by using a proportional and integral control loop to actuate an adjustable interjectory air register.

* * * * *